US006416428B1

(12) United States Patent
Tygar et al.

(10) Patent No.: US 6,416,428 B1
(45) Date of Patent: Jul. 9, 2002

(54) PNEUMATIC GOLF BALL LAUNCHING DEVICE

(75) Inventors: Robert A. Tygar, Budd Lake; Stanley E. Chrapowicki, Neshanic Station; Eric S. Blasic, High Bridge, all of NJ (US)

(73) Assignee: United States Golf Association, Far Hills, NJ (US)

( * ) Notice: Subject to any disclaimer, the term of this patent is extended or adjusted under 35 U.S.C. 154(b) by 0 days.

(21) Appl. No.: 09/386,753

(22) Filed: Aug. 31, 1999

(51) Int. Cl.[7] ..... A63B 67/00
(52) U.S. Cl. ..... 473/415; 124/77
(58) Field of Search ..... 473/415; 124/77, 124/71, 73, 56

(56) References Cited

U.S. PATENT DOCUMENTS 884,024 A * 4/1908 Lake ..... 142/73
2,182,369 A * 12/1939 Barron ..... 124/81
2,634,717 A * 4/1953 Junkin ..... 124/75
3,288,127 A * 11/1966 Bullock ..... 124/73
3,662,729 A * 5/1972 Henderson ..... 124/73
5,327,878 A * 7/1994 Wittbrot ..... 124/41.1
5,572,982 A * 11/1996 Williams ..... 124/74
5,613,483 A * 3/1997 Lukas et al. ..... 124/73
5,640,945 A * 6/1997 Slonaker et al. ..... 124/56
5,878,736 A * 3/1999 Lotuaco, III ..... 124/71
5,881,707 A * 3/1999 Gardner, Jr. ..... 124/77

* cited by examiner

*Primary Examiner*—Paul T. Sewell
*Assistant Examiner*—M. Chambers
(74) *Attorney, Agent, or Firm*—Francis C. Hand, Esq.; Carella, Byrne et al.

(57) ABSTRACT

The golf ball launching device employs an annular ring for mounting a golf ball within a barrel of the launching device upstream of a hinged cover through which the ball is mounted in the barrel. A blast of air from one end of the barrel propels the ball off the ring at a consistent velocity.

9 Claims, 1 Drawing Sheet

PNEUMATIC GOLF BALL LAUNCHING DEVICE

Figure 1:
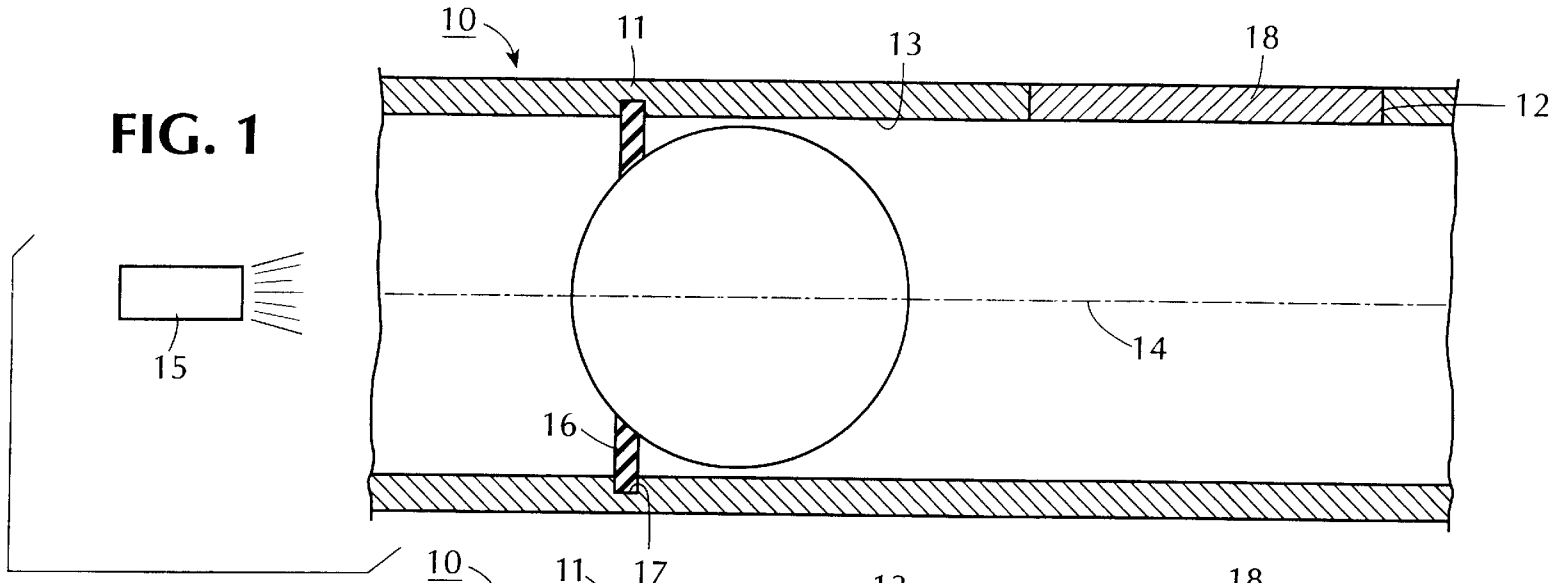

This invention relates to a golf ball launching device.

Heretofore, various types of equipment have been used for testing golf balls and the like. In some cases, use has been made of a mechanical device which is programmed to swing a golf club in a repeated pattern for driving golf balls in seriatim from a fixed tee position in order to test for travel distances of the golf balls. In other types of equipment, pneumatic launching devices have been used to launch a golf ball from a tube through a path along which sensors are provided for recording the flight of the ball. Still other types of launchers are known which utilize pairs of moving endless belts to launch a golf ball from between the belts.

One particularly known launching device employs a barrel into which a golf ball may be mounted via a hinged cover in the side of the barrel. In this type of launching device, the ball has been abutted against a sealing ring within the bore of the barrel. After closing the cover, a pneumatic charge is delivered to the barrel so as to push the ball through the sealing ring and thence out of the barrel at a high speed. However, one of the problems associated with this type of launching device is that there has been an inconsistency in the velocity of the balls which have been launched. Typically, this inconsistency has been found to be from ½to 2 feet/second (fps).

In order to accurately measure the characteristics of a ball, it has been necessary to have consistency in the spin and velocity of the launched ball, for example, for measuring distance, for determining the coefficient of restitution and for measuring impact, among other matters. If the velocity changes, the ball may not hit the target against which the ball is to impact or may not land where the ball is intended to land on a range, for example to measure bounce.

Accordingly, it is an object of the invention to obtain a consistent velocity in the launching of a golf ball from a pneumatic launching device.

It is another object of the invention to be provide a simplified launching device for launching golf balls at a consistent high speed.

Briefly, the invention provides a golf ball launching device which is comprised of a barrel having an elongated bore and a movable cover for providing access to the bore, means at one end of the barrel for injecting a blast of air through the barrel and a support means mounted in the bore to dispose the center of a ball on a longitudinal axis of the bore between the means for injecting the blast of air and the cover. That is to say, the support means is disposed upstream of the cover.

The support means may be in the form of an elastomeric annular ring, a plurality of circumferentially spaced apart pins, elastic fingers, ramps, or the like, any one of which is characterized in centering a ball on the centerline of the bore and holding the ball in place.

In use, with the cover open, a ball is placed within the barrel and seated against the support means. The cover is then closed and the pneumatic means actuated for injecting a blast of air through the barrel. At this time, there is no need for the ball to pass through the support means as the ball is seated on the side of the support means which is opposite from the pneumatic means for injecting a blast of air into the barrel. Repeated launchings of balls have shown that the balls are launched at a consistent velocity.

The launching device may also be provided with accessories, such as a positioning device for manipulating the ball into a seated fit in the support means.

Figure 2:
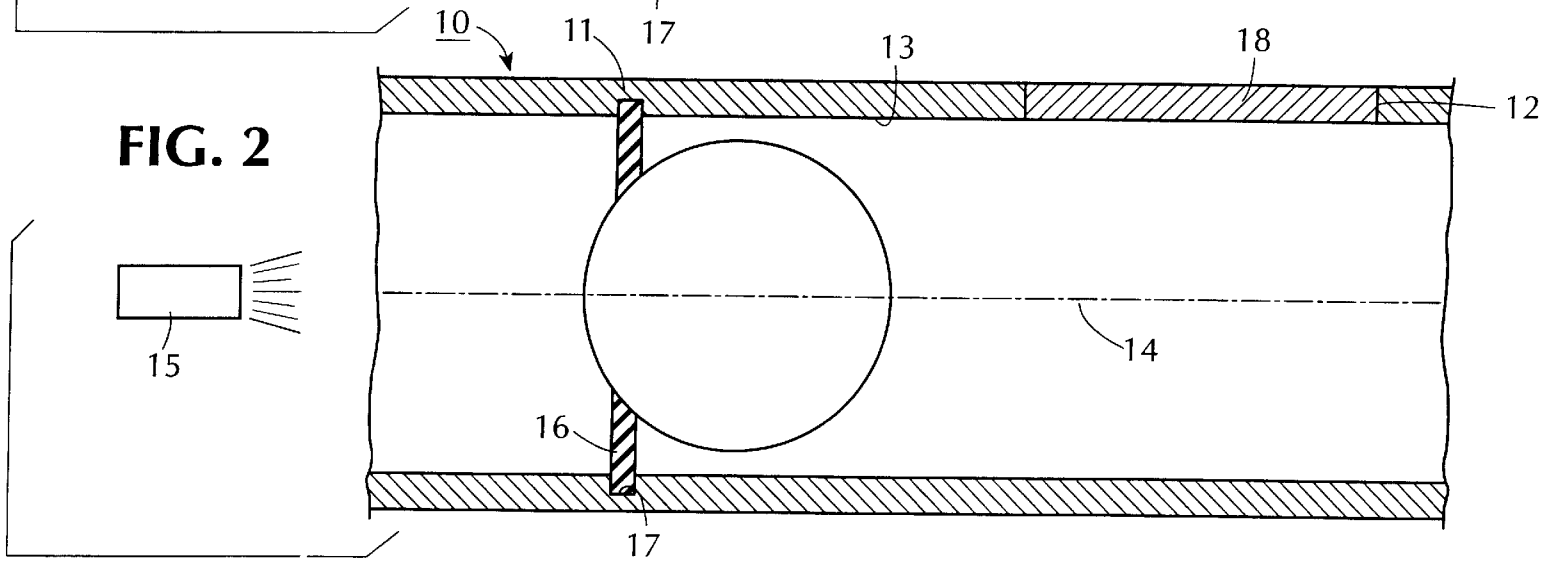

These and other objects and advantages of the invention will become more apparent from the following detailed description taken in conjunction with the accompanying drawings wherein:

FIG. 1 illustrates a part schematic cross sectional view of a golf ball launching device constructed in accordance with the invention; and Fig.2 illustrates a view similar to FIG. 1 with a ball of smaller diameter in the launching device.

Referring to FIG. 1, the golf ball launching device 10 is of generally known construction and includes a barrel 11 having an elongated forward portion 12 defining a bore 13 which is disposed on a longitudinal axis 14 and which has a length of 25 inches and a bore (inside diameter) of 1.750 inches.

A pneumatic means 15 is provided at the rear end of the barrel 11 for injecting a blast of air into the barrel 11. This pneumatic means 15 is of conventional structure and need not be further described.

The barrel 11 has a movable cover 16, such as a hinged cover, for providing a lateral opening into the bore 13 for passage of a golf ball 17 into the bore of the barrel 11 for launching purposes.

The launching device 10 also includes a support means 18, for example in the form of an elastomeric annular ring, which is mounted in an annular groove 19 in the bore 13 coaxially of the axis 13 and between the pneumatic means 15 and the cover 16, i.e. upstream of the cover 16.

When the cover 16 is pivoted to an opened position, the resulting lateral opening provides a sufficient space for a golf ball 17 to be inserted into the bore 13 in the barrel 11 for mounting in the ring 18. In addition, when closed, the cover 16 may be locked by any suitable means (not shown).

As indicted in FIG. 1, the launching device 10 is sized so as to receive a golf ball 17 of smaller size than the inner diameter of the bore 13. For example, the ball 17 may have an outside diameter of 1.680 inches.

The nature of the ring 18 is such that the golf ball 17 may be fitted into the opening of the ring 18 and held in spaced circumferential relation to the bore 13 of the barrel 11. For example, the ring 18 has a tapered annular surface 20 coaxially of the longitudinal axis 14 of the bore 13 defining an aperture and on which the ball 17 is received and held, for example, with a friction fit. Due to the tapering of the surface 20, different sized balls may be received and held in place. As indicated in FIG. 2, wherein like characters indicate like parts as above, a ball 17' may be mounted within the ring 18 and held in place in a similar manner.

A positioning device such as a plunger (not shown) may also be used to position the ball 17 in the ring 16 when the cover 16 is in the opened condition. Alternatively, the ball 17 may be positioned manually in the ring 18.

The barrel 11 is typically made of a length of 25 inches. This allows a ball 17 to be pneumatically ejected from the barrel 11 at a high speed.

In order to use the launching device 10, the cover 16 is moved to the opened position. At this time, a ball 17 is passed through the resulting opening into the barrel 11. Next, with or without the use of a positioning device, the ball 17 is pushed in an upstream direction within the barrel 11 so as to be seated in the elastomeric ring 18. This allows the ball 17 to become circumferentially spaced from the wall of the bore 13 while, at the same time, the annular ring 18 forms a seal relative to the annular gap defined between the ball 17 and the bore 13.

After the cover 16 is closed and locked, the pneumatic means 15 of the launching device 10 is activated so that a blast of air is delivered, in known fashion, against the seated ball 17 so that the ball is thus propelled out of the barrel 11 at a high speed. Since the ball 17 is seated on the opposite side of the ring 18 from the pneumatic means 15, the ring 18 does not impede the launching of the ball 17 so that little or no drag force is imposed on the ball which may otherwise reduce the velocity of the launched ball. Continued testing has shown that balls may be launched with a consistent velocity from ball-to-ball.

Typically, barrel 11 is mounted on a horizontal axis 13 but may also be slightly angled upwardly so as to expel the ball 17 at a vertical angle to the horizontal plane.

In the event that the annular ring 18 becomes worn over time, the ring 18 may be readily removed from the groove 19 and replaced by a fresh ring via the opening provided when the cover 16 is opened.

The invention thus provides a ball launching device of relatively simple construction wherein a ball can be readily loaded for flight and expelled from a barrel at a consistent velocity.

What is claimed is:

1. A golf ball launching device comprising a barrel having an elongated bore disposed on a longitudinal axis and a movable cover for providing access to said bore;

pneumatic means at one end of said barrel for injecting a blast of air through said barrel; and support means mounted in said bore between said pneumatic means and said cover to dispose a center of a ball on said axis.

2. A golf ball launching device as set forth in claim 1 wherein said support means is an elastomeric annular ring.

3. A golf ball launching device as set forth in claim 2 wherein said ring has an inside diameter less than said inside diameter of said bore.

4. A golf ball launching device as set forth in claim 2 wherein said ring has an inside diameter for seating a golf ball therein of a diameter of 1.680 inches.

5. A golf ball launching device as set forth in claim 1 wherein said support means has a tapered annular surface coaxially of said longitudinal axis defining an aperture for receiving and holding balls of different diameters.

6. A golf ball launching device as set forth in claim 1 wherein said barrel has a length of 25 inches and a bore of 1.750 inches.

7. A golf ball launching device comprising a barrel having a bore for pneumatically launching a golf ball and a movable cover for providing a lateral opening into said bore for passage of a golf ball into said bore; and support means in said bore of said barrel upstream of said lateral opening for mounting the golf ball coaxially within said bore of said barrel whereby repeated pneumatic launchings of the ball from said support means result in launchings of consistent velocities downstream of said lateral opening.

8. A golf ball launching device as set forth in claim 7 wherein said support means is an elastomeric annular ring.

9. A golf ball launching device as set forth in claim 8 wherein said ring has a tapered annular surface for seating golf balls of different sizes therein.

* * * * *